United States Patent [19]

Hoenstine et al.

[11] Patent Number: 4,552,539

[45] **Date of Patent: * Nov. 12, 1985**

[54] HYDROPLANE APPARATUS

[76] Inventors: James M. Hoenstine, 3201 Alamo Dr., Orlando, Fla. 32805; Thomas E. Ray, 2512 Trentwood Blvd., Orlando, Fla. 32812

[ * ] Notice: The portion of the term of this patent subsequent to May 29, 2001 has been disclaimed.

[21] Appl. No.: 614,108

[22] Filed: May 24, 1984

Related U.S. Application Data

[62] Division of Ser. No. 424,105, Sep. 27, 1982, Pat. No. 4,451,239.

[51] Int. Cl.[4] ..... B63B 7/08

[52] U.S. Cl. ..... 441/66; 441/131; 441/67

[58] Field of Search ..... 441/66, 65, 67, 40, 441/43, 83, 125, 130, 131; 114/253

[56] References Cited

U.S. PATENT DOCUMENTS

| | | | |
|---|---|---|---|
| 2,683,270 | 7/1954 | Long | 441/40 |
| 2,876,467 | 3/1959 | Lund | 441/40 |
| 3,080,584 | 3/1963 | Brown | 441/67 |
| 3,135,978 | 6/1964 | Grasmoen | 441/66 |
| 3,657,753 | 4/1972 | LeBlanc | 441/66 |
| 4,030,151 | 6/1977 | McKeen | 441/66 |
| 4,366,963 | 1/1983 | Reeves | 441/67 |
| 4,451,239 | 5/1984 | Hoenstine | 441/66 |

*Primary Examiner*—Trygve M. Blix
*Assistant Examiner*—C. T. Bartz
*Attorney, Agent, or Firm*—Duckworth, Allen, Dyer & Pettis

[57] ABSTRACT

An inflatable hydroplane apparatus uses a pneumatic vehicle innertube with a flexible fabric cover including an annular flexible fabric positioned partly covering said innertube and forming a smooth bottom therefor. A handle strap is stitched to said cover for the rider to hold on to and a tow rope attaching strap is stitched to the bottom portion of the cover for attaching a tow rope from a boat for pulling the hydroplane. The innertube is inflated in the cover to form the hydroplane and deflated for storage.

11 Claims, 5 Drawing Figures

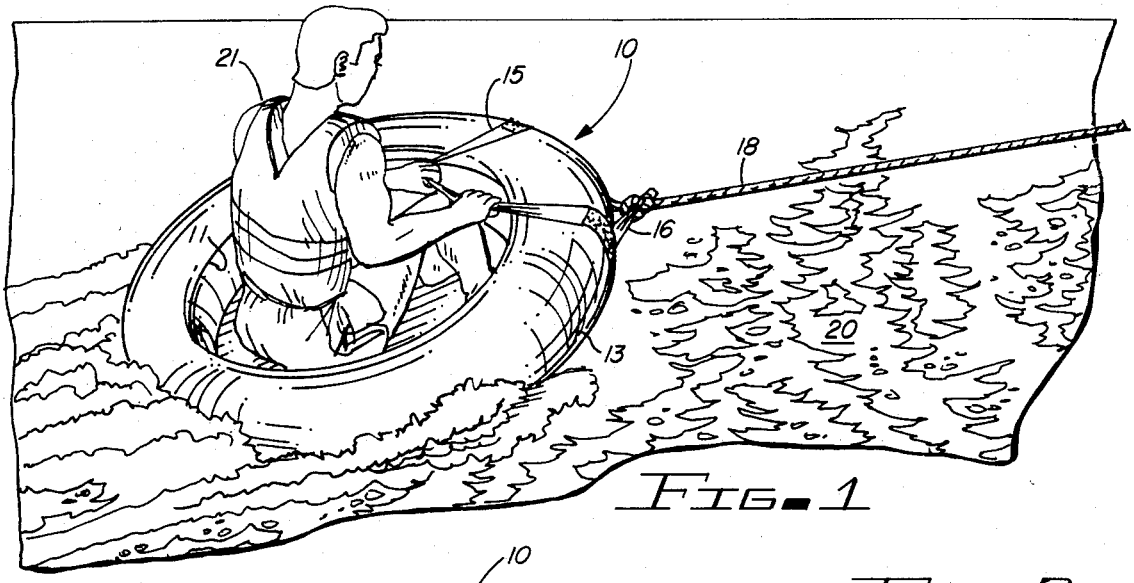
FIG. 1
FIG. 2
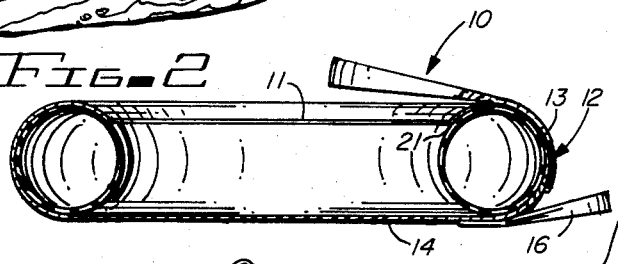
FIG. 3
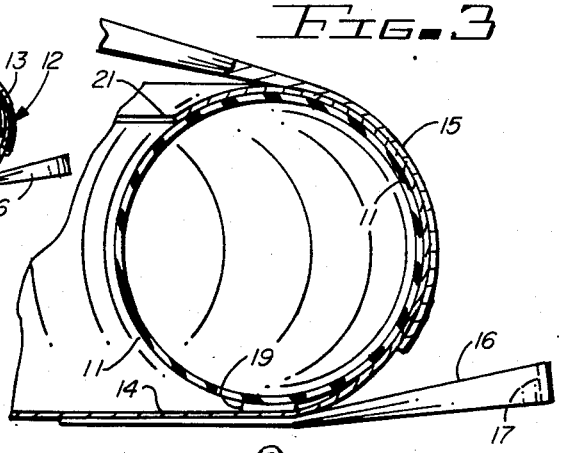
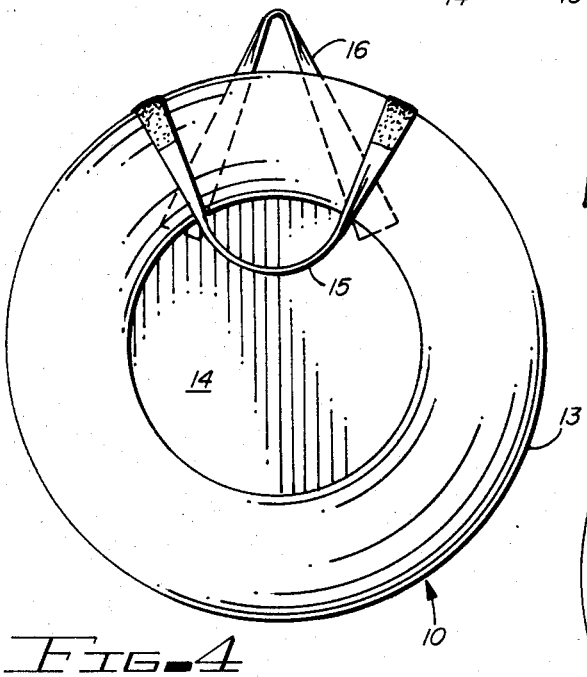
FIG. 4
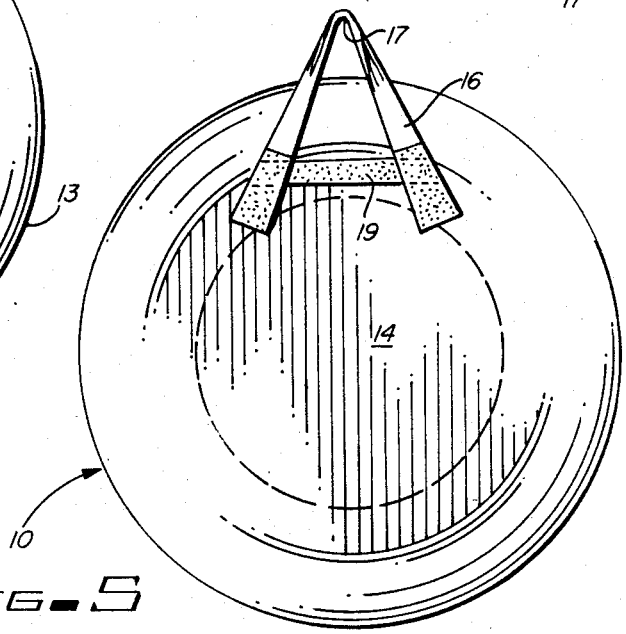
FIG. 5

HYDROPLANE APPARATUS

This application is a division of application Ser. No. 424,105 filed Sept. 27, 1982, now U.S. Pat. No. 4,451,239.

BACKGROUND OF THE INVENTION

The present invention relates to hydroplanes and especially to inflatable hydroplanes using a pneumatic innertube.

In the past, it has been common to make a great variety of hydroplaning devices and typically these involve a large board having a smooth bottom conectable to a tow rope for pulling behind a motor boat. A long rope handle allows the user to ride the hydroplane while standing up. It has also been common to have a variety of inflatable water toys, surfboards, and the like, and a number of prior art devices have utilized pneumatic innertubes built for land vehicle tires. Pneumatic innertubes have been commonly used for flotation on bodies of water in an informal manner, sometimes referred to as "tubing." In addition, various devices have been attached to innertubes for use in various types of games or sports, including land and water usage. In one prior U.S. Pat. No. 4,030,151, a tow strap for a pneumatic innertube provides a strap for strapping around a typical vehicle innertube to provide an attachment for a tow rope and having a single handle along with a rudder protruding therefrom. In U.S. Pat. No. 3,135,978 a pneumatic cushion coaster slide provides an attachment for an inflatable tube having a pair of handles thereon to act as a sled or on a water slide for coasting down snow-covered slopes or a waterslide.

U.S. Pat. No. 3,657,753 shows a typical folding inflatable surfboard and there are a number of similar prior art inflatable devices. The present invention is directed towards a lightweight partial cover for a large inflatable innertube to provide a smooth bottom and having a supported handle and a tow rope attachment to provide an inflatable hydroplane which can be rapidly pulled across the surface of a body of water.

SUMMARY OF THE INVENTION

An inflatable hydroplane apparatus combines a vehicle pneumatic innertube with a flexible fabric innertube cover, the cover includes an annular flexible nylon fabric material partially covering the innertube and forming a smooth bottom thereto. A handle, which is made of a nylon fabric strap stitched to the innertube cover for a rider to hold onto and a tow rope attaching nylon strap is attached to the bottom portion of the cover for attaching a tow rope for pulling the hydroplane. Thus, a large pneumatic innertube can be inflated within the cover to be used as a hydroplane and deflated for storage. A special nylon fabric allows the hydroplane to skim the water with reduced friction while forming a seat for the user. The strength of the nylon strapping allows it to be stitched to the cover, so that the hydroplane can be pulled through the water without substantially deforming of the innertube.

BRIEF DESCRIPTION OF THE DRAWINGS

Other objects, features and advantages of the present invention will be apparent from the written description and the drawings, in which:

FIG. 1 is a perspective view of a hydroplane in accordance with the present invention having a rider being pulled by a tow rope;

FIG. 2 is a sectional view taken through the hydroplane of FIG. 1;

FIG. 3 is a sectional view taken through a portion of the hydroplane of FIGS. 1 and 2;

FIG. 4 is a top plan view of the hydroplane in FIGS. 1 through 3; and FIG. 5 is a bottom plan view of the hydroplane of FIGS. 1 through 4.

DESCRIPTION OF THE PREFERRED EMBODIMENT

Referring to the drawings, a hydroplane 10 is shown having a large land vehicle tire innertube 11 inflated in a cover 12 having an annular portion 13 for receiving the tube 11 and a bottom portion 14 extending over the bottom of the tube to fill in the center opening and provide a smooth bottom. Cover 12 is made of a flexible nylon fabric, such as cordura, which provides a smooth, slick bottom surface for the hydroplane to slide through the water with the strength to hold an individual riding therein. The cover 12 has a strap handle 15 which is made of a nylon strapping material, such as found in seat belts, which has been heavily stitched with nylon thread in two places to the cover. A second nylon strap 16 has been heavily stitched to the bottom of the cover in two places in order to provide a loop 17 for attaching a tow rope 18, which is attached at the other end to a boat to pull the hydroplane through the water 20. A reinforcement fabric strap 19 is attached to strap 16 through the bottom 14 so that the nylon stitching extends through the strap 16, bottom 14 and strap 19, which is hidden between the bottom and the innertube 11.

Using heavy nylon strapping such as used in seat belts and being attached at the predetermined locations on the cover with heavy stitching allows the hydroplane 10 to be pulled by the tow rope 18 while the user 21 holds onto the handle 15. This allows a wide variety of maneuvers in the water without substantially deforming the hydroplane, since stresses are spread across the front of the cover and tube. Advantageously, the stitched-on straps and smooth nylon material allow the hydroplane to skim through the water and be readily controlled by an individual. The strapping material is also provided with reinforced edges 21 to add strength to the system. The innertube 11 can be placed in the cover 12 and inflated to form the hydroplane and can be readily deflated and folded up for storage.

It should be clear at this point that an inflatable, deflatable hydroplane has been provided which utilizes an ordinary, pneumatic innertube. However, the invention is not to be considered to be limited to the forms shown, which are to be considered illustrative rather than restrictive.

We claim:

1. A recreational hydroplane apparatus for towing behind a boat or the like, said apparatus comprising:

(a) an annular inflatable tube member having a round, central hole extending therethrough;

(b) a unitary flexible cover surrounding the outer periphery of said tube, said cover having an annular central opening therein concentric with said central hole in said tube, said opening in said cover having a substantially smaller dimension than the outer periphery of said tube, said cover further including a closed, substantially flat bottom along a side opposite said annular central opening thereof, said cover and said tube being dimensioned such that said bottom is drawn tightly across said central hole in said tube when said tube is inflated;

(c) a flexible handle attached to, and extending across the periphery of said cover and toward said annular central opening of said cover, said handle dimensioned such that a person sitting within said central hole and on said bottom of said tube can grasp said handle;

(d) a fabric tow strap having each end portion thereof sewn only to, and extending along the plane of said flat bottom, said tow strap including a loop to which a tow rope may be fastened; and wherein (e) the attachment of said tow strap along the plane of said flat bottom and the drawing tight of said fabric cover bottom across said central hole of said tube allows said hydroplane apparatus to skim along the surface of water when being towed.

2. The hydroplane apparatus recited in claim 1 wherein said cover includes a reinforcing border around the edge of said annular central opening.

3. The hydroplane apparatus recited in claim 1 wherein said flexible cover comprises nylon cordura which provides a smooth, slick outside surface for said bottom, whereby hydroplaning of said apparatus is facilitated.

4. The hydroplane apparatus recited in claim 1 wherein said handle and said tow strap comprises a nylon strap material.

5. The hydroplane apparatus recited in claim 1 wherein said tow strap is sewn along the outside surface of said flat bottom.

6. A hydroplane apparatus recited in claim 5 further comprises a reinforcing strap sewn across said bottom between said tube and said cover, said reinforcing strap further sewn through said cover to each end portion of said tow strap.

7. A recreational hydroplane apparatus for towing behind a boat or the like, said apparatus comprising:

(a) an annular inflatable tube member having a round, central hole extending therethrough;

(b) a unitary flexible cover surrounding the outer periphery of said tube, said cover having an annular central opening therein concentric with said central hole in said tube, said opening in said cover having a substantially smaller dimension than the outer periphery of said tube, said cover further including a closed, substantially flat bottom along a side opposite said annular central opening thereof, said cover and said tube being dimensioned such that said bottom is drawn tightly across said central hole in said tube when said tube is inflated;

(c) a fabric tow strap having each end portion thereof sewn only to, and extending along the plane of said flat bottom, said tow strap including a loop to which a tow rope may be fastened; and wherein (d) flexible handle means sewn at two points on said flexible cover, said handle means extending toward said annular central opening of said cover, said handle means dimensioned such that a person sitting within said central hole in said tube and on said bottom can grasp said handle means, permitting said person to control and maneuver said hydroplane apparatus as it skims through the water.

8. The hydroplane apparatus recited in claim 7 wherein each of said two points of attachment of said handle means to said cover are aligned on opposite sides of said tow strap.

9. The hydroplane apparatus recited in claim 8 wherein said handle means comprises a loop having two ends, each end sewn to said cover at one of said points of attachment.

10. The hydroplane apparatus recited in claim 9 wherein said loop extends across said annular central opening of said cover.

11. A recreational hydroplane apparatus for towing behind a boat or the like, said apparatus comprising:

(a) an annular inflatable tube member having a round, central hole extending therethrough;

(b) a unitary flexible cover surrounding the outer periphery of said tube, said cover having an annular central opening therein concentric with said central hole in said tube, said opening in said cover having a substantially smaller dimension than the outer periphery of said tube, said cover further including a closed, substantially flat bottom along a side opposite said annular central opening thereof, said cover and said tube being dimensioned such that said bottom is drawn tightly across said central hole in said tube when said tube is inflated;

(c) a fabric tow strap having each end portion thereof sewn only to, and extending along the plane of said flat bottom, said tow strap including a loop to which a tow rope may be fastened; and (d) a flexible handle comprising a loop of fabric material, each end of said fabric handle sewn on an opposite side of said tow strap, said loop extending across said annular opening of said cover, whereby a person sitting within said central hole in said tube and on said bottom can hold on to said handle loop, permitting said person to control and maneuver said hydroplane apparatus as it skims through the water.

* * * * *